US009551139B2

(12) United States Patent
Todd, IV

(10) Patent No.: US 9,551,139 B2
(45) Date of Patent: Jan. 24, 2017

(54) URINE SPLASH GUARD

(71) Applicant: William Upton Todd, IV, Egg Harbor Township, NJ (US)

(72) Inventor: William Upton Todd, IV, Egg Harbor Township, NJ (US)

( * ) Notice: Subject to any disclaimer, the term of this patent is extended or adjusted under 35 U.S.C. 154(b) by 1 day.

(21) Appl. No.: 14/740,421

(22) Filed: Jun. 16, 2015

(65) Prior Publication Data

US 2016/0369488 A1 Dec. 22, 2016

(51) Int. Cl.
*E03D 9/00* (2006.01)
*A47K 13/24* (2006.01)

(52) U.S. Cl.
CPC ..... *E03D 9/00* (2013.01); *A47K 13/24* (2013.01)

(58) Field of Classification Search
CPC ..... E03D 9/00
USPC ..... 4/300–442
See application file for complete search history.

(56) References Cited

U.S. PATENT DOCUMENTS 4,912,784 A * 4/1990 Jacobson ..... E03D 9/00 222/192
5,216,760 A * 6/1993 Brown ..... A47K 13/08 4/245.4
5,625,905 A * 5/1997 Woods ..... E03D 9/00 4/300.3
5,815,851 A * 10/1998 Perry ..... A47K 13/24 4/300.3
6,119,282 A * 9/2000 Serbin ..... A47K 13/24 4/300.3
6,408,447 B1 * 6/2002 Burbank ..... A47K 13/24 4/300.3
6,550,075 B1 * 4/2003 Brannon, III ..... A47K 13/24 4/300.3
7,178,177 B1 * 2/2007 Valencia ..... E03D 9/00 4/300.3
7,412,732 B1 * 8/2008 Leonard ..... E03D 9/00 4/300.3
7,921,478 B1 * 4/2011 Vanini ..... E03D 9/00 4/144.1
7,996,926 B2 * 8/2011 Aguila ..... A47K 11/12 4/144.1
2002/0038475 A1 * 4/2002 Garrett ..... A47K 13/24 4/300.3
2005/0193482 A1 * 9/2005 Gambla ..... E03D 9/00 4/300.3
2006/0041998 A1 * 3/2006 Lattanzi ..... E03D 9/00 4/300.3
2009/0211007 A1 * 8/2009 Partridge ..... A47K 13/24 4/300.3

(Continued)

*Primary Examiner* — Lori Baker
(74) *Attorney, Agent, or Firm* — Stuart M. Goldstein

(57) ABSTRACT

A urine splash guard for a toilet bowl has a first splash guard member having an intermediate section interconnecting dual, forwardly extending arm sections, the sections being connected by fold joints, and a second splash guard member which is permanently connected to the arm sections. The second splash guard member is connected to the intermediate section by a fold joint and is fixedly attached to the underside of the toilet bowl seat. When the toilet bowl seat overlays the toilet bowl rim, the splash guard is compacted into a flat orientation on the toilet bowl rim. When the toilet bowl seat is raised and lifted, the various sections of the splash guard are rotated upward, to a vertical orientation, thereby covering the vulnerable areas of the toilet bowl rim and toilet bowl seat during urination.

12 Claims, 6 Drawing Sheets

(56) References Cited

U.S. PATENT DOCUMENTS

| | | | | |
|---|---|---|---|---|
| 2009/0320198 | A1* | 12/2009 | Yefremov | E03D 9/00 4/300.3 |
| 2012/0096633 | A1* | 4/2012 | Escudero | E03D 9/00 4/300.3 |
| 2015/0040303 | A1* | 2/2015 | Uhm | E03D 9/00 4/300.3 |
| 2016/0108609 | A1* | 4/2016 | Escudero | E03D 9/00 4/300.3 |

* cited by examiner

URINE SPLASH GUARD

BACKGROUND OF THE INVENTION

The present invention relates to the field of toilet bowl urine protectors, shields, or guards. More particularly, it addresses the problems associated with protecting the toilet bowl, toilet bowl seat and toilet bowl rim from the inadvertent splashing of urine or of misdirected male urine streams.

Splash shields are provided for the protection and the cleanliness of toilet, bowl surfaces. Especially during the male urination process, urine often splashes out of the toilet bowl and urine streams sometimes miss their intended toilet bowl targets. Young boys, particularly those who are just being trained to urinate in a toilet, are more apt to miss the toilet bowl. Splash guards are uniquely utilized to address such situations. Nonetheless, while there are numerous different splash shields and protectors, none are compact, easy to install and remove, and effective in preventing unintentional soiling of toilet bowls.

SUMMARY OF THE INVENTION

It is therefore the object of the present invention to overcome the disadvantages and limitations of prior urine splash guard protectors, shields, and guards.

It is the object of the present invention to provide a mine splash guard which is compact, lightweight, portable, and easily installed and removed on an existing toilet bowl rim.

It is another object of the present invention to provide a urine splash guard which will automatically open and deploy for use, upon the lifting and raising of the toilet bowl seat.

It is a further object, of the present invention to provide a urine splash guard which, once opened and deployed, is effective in protecting the toilet bowl and its components from misdirected urine streams by shielding the toilet bowl, the toilet bowl seat, and the toilet bowl rim from urine and by redirecting the urine into the toilet bowl itself.

These and other objects are accomplished by the present invention, a urine splash guard for a toilet bowl having a first splash guard member having an intermediate section interconnecting dual, forwardly extending arm sections, the sections being connected by fold joints, and a second splash guard member which is permanently connected to the arm sections. The second splash guard member is connected to the intermediate section by a fold joint and is fixedly attached to the underside of the toilet bowl seat. When the toilet bowl seat overlays the toilet bowl rim, the splash guard is compacted into a flat orientation on the toilet bowl rim. When the toilet bowl seat is raised and lifted, the various sections of the splash guard are rotated upward, to a vertical orientation, thereby covering the vulnerable areas of the toilet bowl rim and toilet bowl seat during urination.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
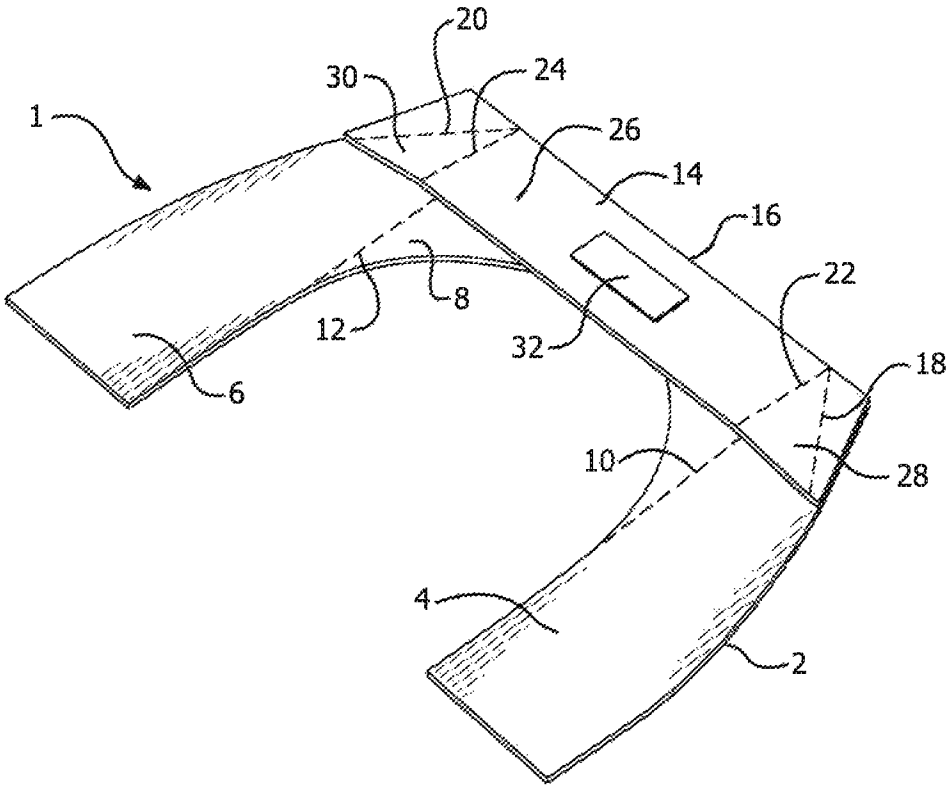
FIG. 1 shows the urine splash guard of the present invention in its flattened position.

Splash guard 1 of the present invention is designed for placement on toilet bowl rim 42 of toilet bowl 40, having toilet bowl seat 44, as will be described in detail below.

Splash guard 1 comprises first splash guard member 2 having forwardly extending splash guard arm sections 4 and 6 interconnected by intermediate section 8. Fold joints 10 and 12 connect arm sections 4 and 6 to intermediate section 8.

Splash guard 1 also comprises second splash guard member 14 connected to intermediate section 8 by fold joint 16. Second splash guard member 14 is fixedly and permanently attached to arm sections 4 and 6 at fold joints 18 and 20. Second splash guard member comprises center splash guard section 26 and lateral splash guard sections 28 and 30. Fold joints 22 and 24 connect center splash guard section 26 to lateral splash guard sections 28 and 30. Splash guard connection means 32, which can be two sided adhesive tape, as shown in the FIGS., or equivalent attachment device such as Velcro® or a similar hook and eye connector, or magnetic connectors, is affixed to center splash guard section 26, for attachment to toilet bowl seat 44.

As is best seen in FIG. 1, the combined shape of first splash guard member 2 and second splash guard member 14 corresponds to the shape of a toilet bowl rim 42 of a toilet bowl 40.

Figure 4:
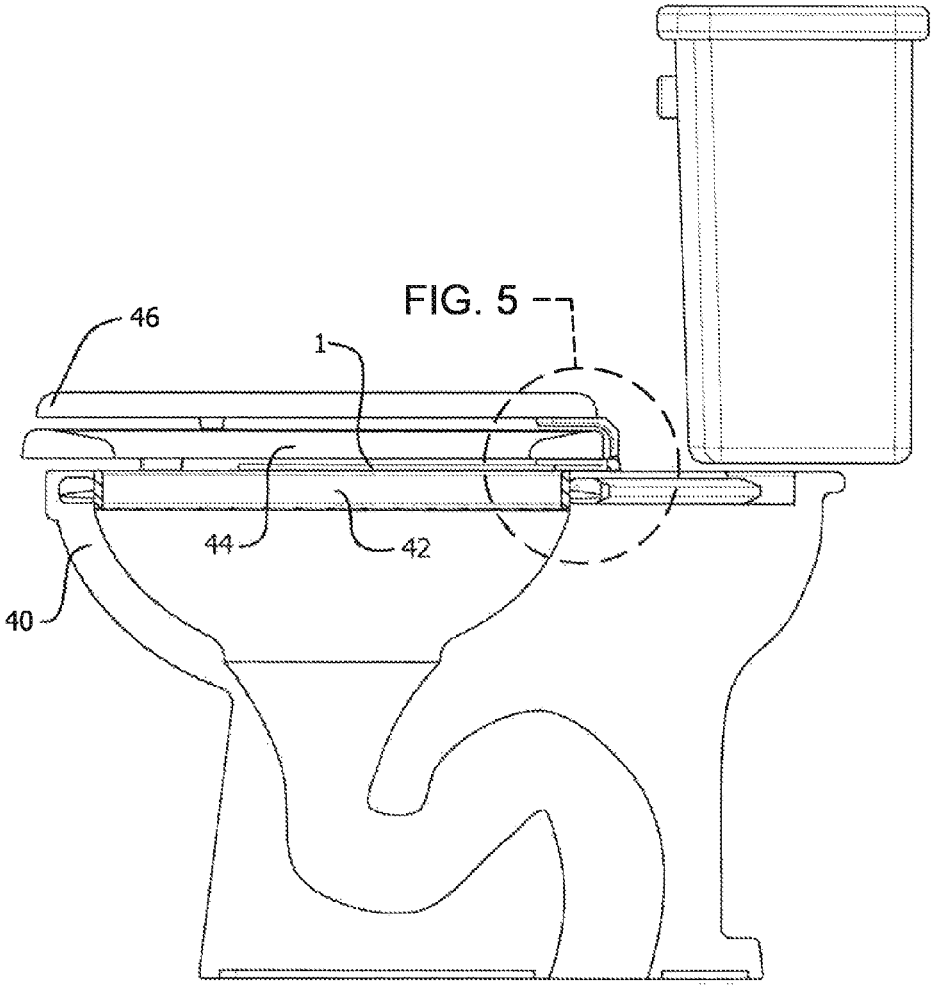
FIG. 4 is a partial cross-sectional view of the urine splash guard of the present invention in its flattened orientation, located on a toilet bowl rim with toilet bowl seat and toilet bowl cover overlaying the splash guard.
Figure 5:
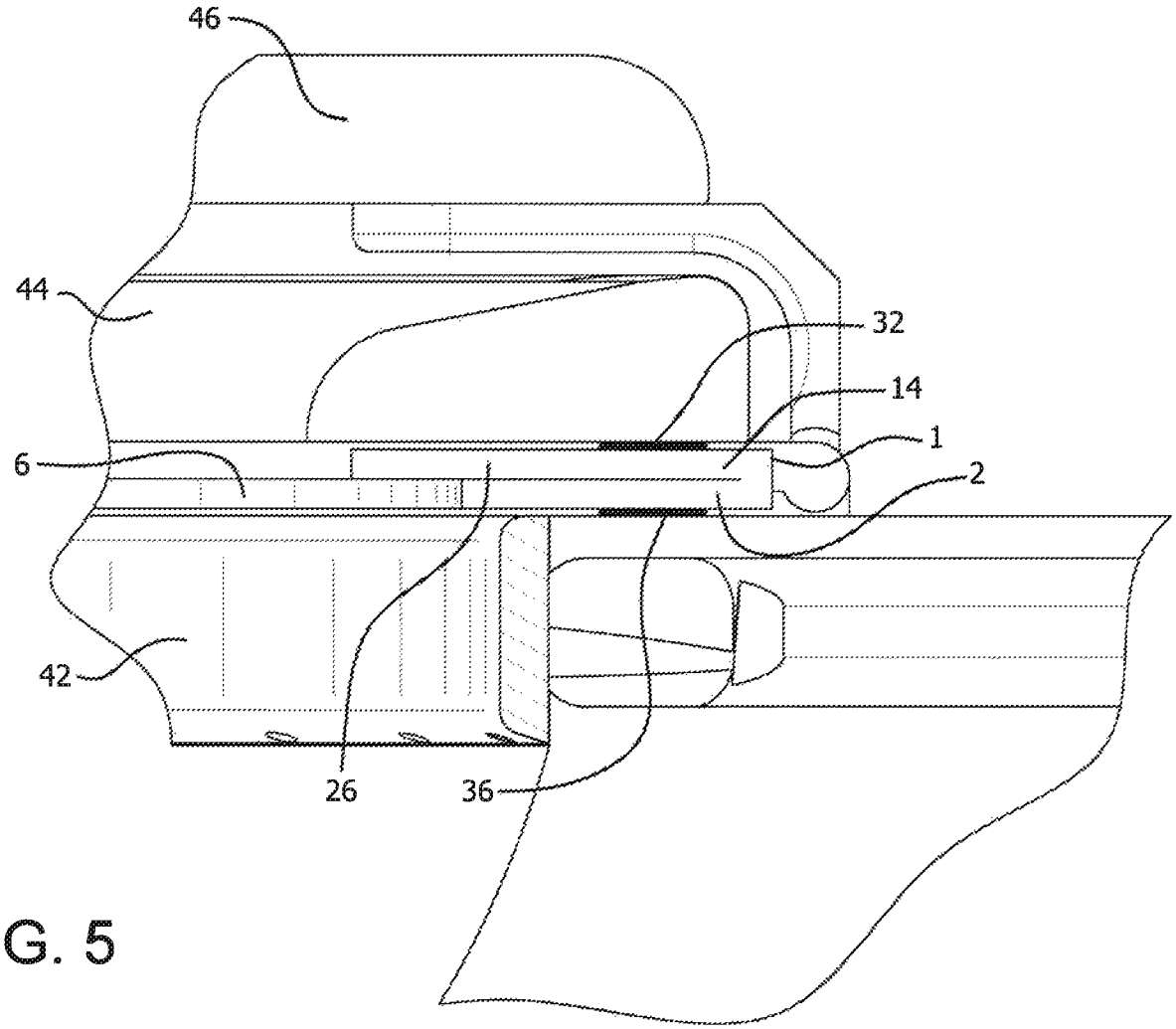
FIG. 5 is a detailed section taken from FIG. 4.

In use, second splash guard member 14 is attached to toilet bowl seat 44 by means of connection means 32 and arm sections 4 and 6 of first guard member 2 are positioned on toilet bowl rim 42, partially circumscribing the toilet bowl rim. In a first position, as shown in FIGS. 1, 4 and 5, toilet bowl seat 44 and also toilet bowl cover 46, are located down over toilet bowl rim 42. In this position, toilet bowl seat 44 overlays and contacts center splash guard section 26, as well as lateral splash guard sections 28 and 30 of second splash guard member 14, and splash guard arm sections 4 and 6 of first splash guard member 2. This maintains these splash guard sections, all components of splash guard 1 itself, in a flat orientation.

Figure 2:
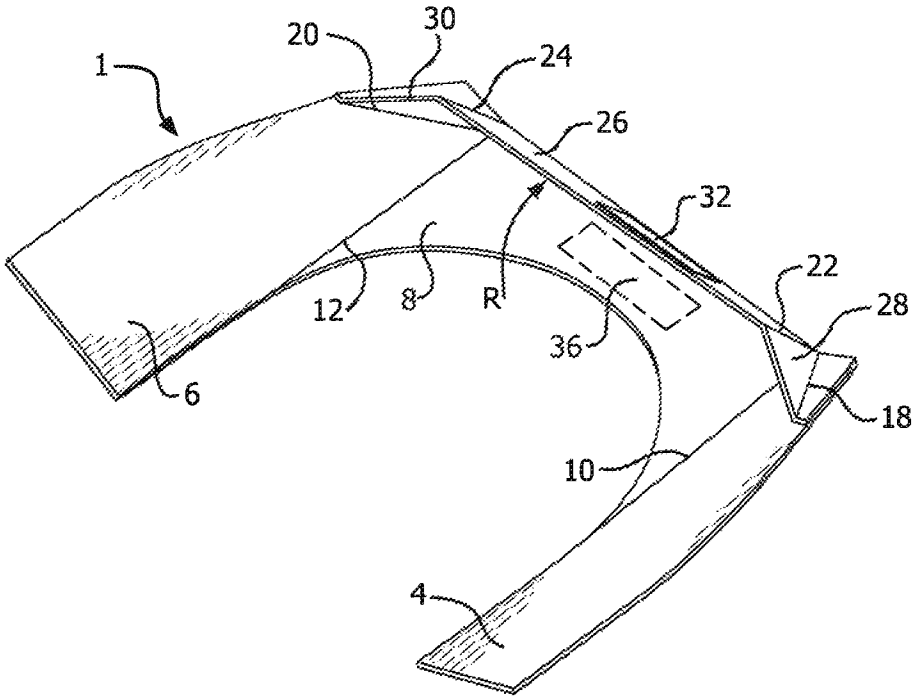
FIG. 2 illustrates the manner of movement of the various sections of the splash guard of the present invention, as a toilet bowl seat (not shown in the figure) is rotated upward.
Figure 3:
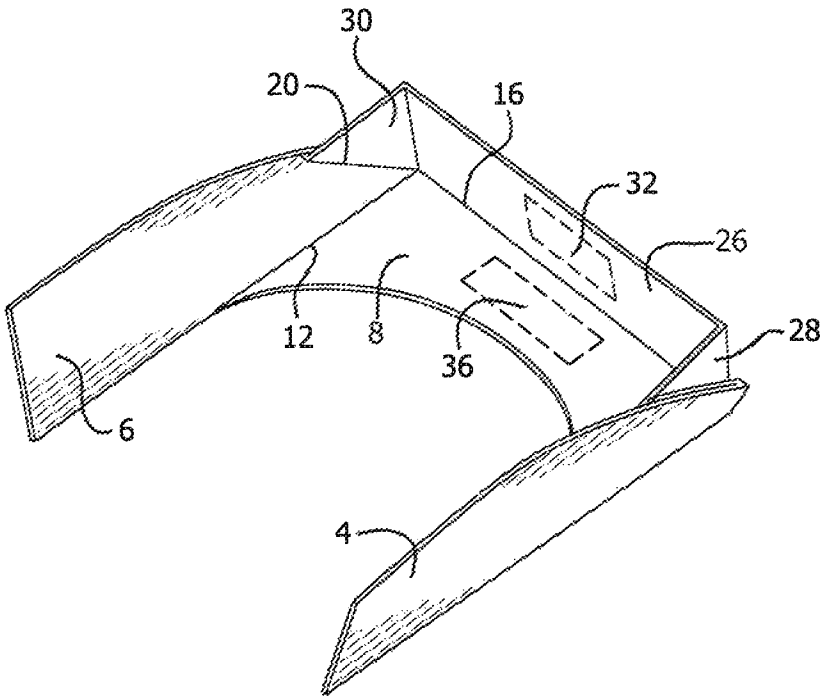
FIG. 3 shows the urine splash guard of the present invention in its full upright, deployed position, with protective sections vertically oriented.
Figure 6:
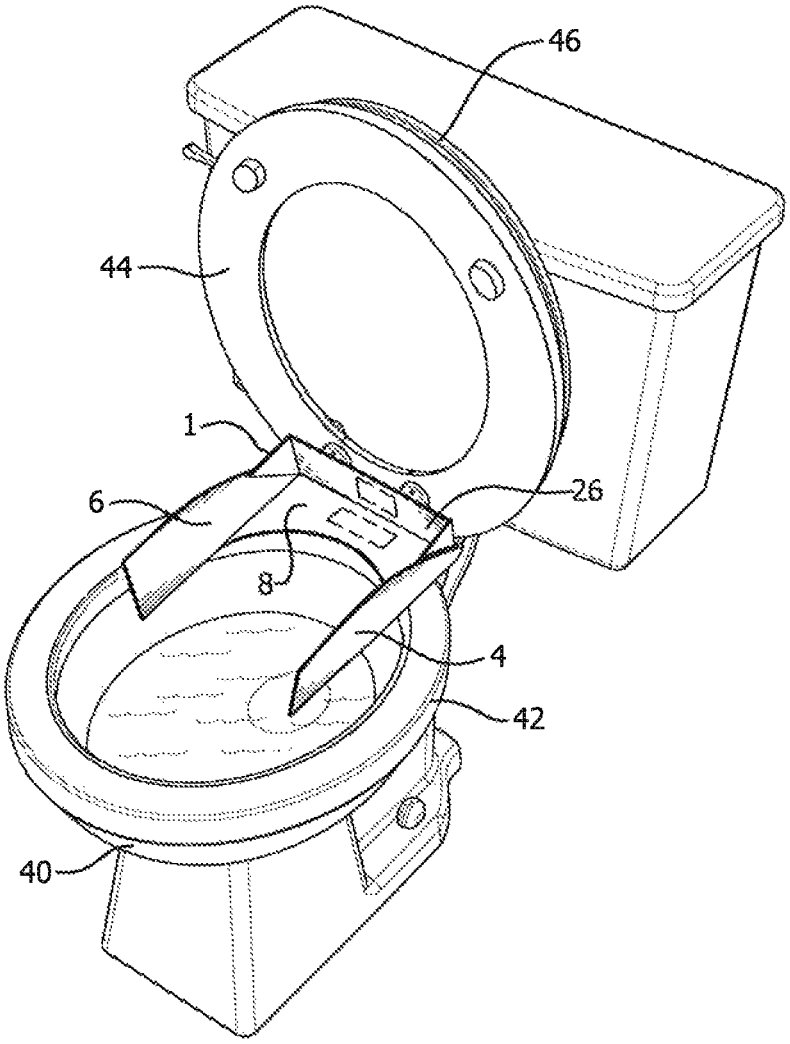
FIG. 6 shows the urine splash guard of the present invention positioned in its deployed, vertically oriented position, located on a toilet bowl rim.

When toilet seat 44 is lifted and rotated R up and away from toilet rim 42, see FIG. 2, connection means 32 between center splash guard section 26 and the toilet seat causes second splash guard member 14 to be rotated upward toward a vertical angle or orientation, by the folding of fold joints 16, 22 and 24. Since arm members 4 and 6 are fixedly attached to second splash member 14, the arm members are also raised and rotated toward a vertical orientation, by the folding of fold joints 18 and 20. When toilet seat 44 is fully vertical, so too is splash guard 1. See FIGS. 3 and 6.

In other words, when toilet bowl seat 44 is rotated from its position overlaying splash guard 1 on toilet bowl rim 42 to a full upright vertical position, up and away from the toilet bowl seat, center splash guard section 26 rotates upward, to compel all the splash guard sections to their vertical orientations. In this position, splash guard 1 effectively serves to protect toilet bowl rim 42 and seat 44 from the splashed or errant spray of urine. In addition, urine which contacts arm sections 4 and 6, intermediate section 8 and center splash guard section 26, is redirected down into the toilet bowl 40 itself.

Of course, rotating toilet seat 44 downward toward toilet rim 42, serves to rotate and unfold the fold joints of splash guard sections 4, 6, 26, 28, and 30. When toilet bowl seat 44 again fully overlays splash guard 1 and toilet bowl rim 42, all splash guard sections are flattened and the splash guide itself reassumes its flat orientation.

It is contemplated that, in order to assist in maintaining splash guard 1 on toilet bowl rim 42, additional connection means 36, e.g. two sided adhesive tape or its equivalent as previously discussed, can be attached between intermediate section 8 and the toilet rim.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A urine splash guard system for a toilet bowl having a toilet bowl rim and a toilet bowl seat rotatable from a first position over the toilet bowl rim to a second position up and away from the toilet bowl rim, said system comprising:

a splash guard located directly on and partially circumscribing the toilet bowl rim, said splash guard comprising two forwardly extending splash guard arm sections, each arm section being rotatable from a flat orientation in which the arm sections are directly on top of the toilet bowl rim, to a vertical orientation in relation to the toilet bowl rim, the splash guard further comprising splash guard connection means for fixedly attaching the splash guard directly to the toilet bowl seat whereby when the toilet bowl seat is in the first position over the toilet howl rim, said toilet bowl seat overlays the arm sections to maintain them in their flat orientations, and when the toilet bowl seat is rotated up from the first position to the second position, up and away from the toilet bowl rim, the arm sections are compelled to rotate to their vertical orientations.

2. The urine splash guard system as in claim 1 wherein the splash guard further comprises a second splash guard and the connection means is located on the second splash guard, whereby as the toilet bowl seat is rotated from the first position to the second position, said second splash guard is compelled to rotate from a flat position to a vertical orientation.

3. A urine splash guard system for a toilet bowl having a toilet bowl rim and a toilet bowl seat positioned over the rim and rotatable to a position up and away from the rim, said system comprising:

a first splash guard member having a clearly defined intermediate section interconnecting clearly defined, dual forwardly extending arm sections, said arm sections being rotatable between a first position in which the arm sections are located directly on to of the toilet rim, to a second position in which the arm sections remain on top of the toilet bowl rim and are at a vertical angle in relation to the intermediate section and the toilet bowl rim; and a second splash guard member permanently affixed to the arm sections, whereby in the first position the second splash guard member overlays the intermediate section and in the second position the second splash guard member rotates with the arm sections to remain on top of the toilet bowl rim and to a vertical angle in relation to the intermediate section and the toilet bowl rim.

4. The urine splash guard system as in claim 3 wherein the toilet seat overlays the first and second splash guard members in the first position and in the second position the toilet seat is rotated up and away from the rim, compelling the arm sections and the second splash guard member to said vertical angle in relation to the intermediate section.

5. The urine splash guard system as in claim 3 wherein the arm sections are connected to the intermediate section by fold joints.

6. The urine splash guard system as in claim 3 wherein the second splash guard member is connected to the intermediate section by a fold joint and wherein said second splash guard member is fixedly connected to the arm sections.

7. The urine splash guard system as in claim 6 further comprising fold joints located between the second splash guard member and the arm sections.

8. A urine splash guard for a toilet bowl having a toilet bowl rim and a toilet bowl seat, said splash guard comprising:

a first splash guard member having a clearly defined intermediate section configured at all times to remain on top of the toilet bowl rim, said section interconnecting clearly defined, dual, forwardly extending arm sections, said intermediate section and said arm sections being connected by fold joints which permit the arm sections to rotate from a position directly on top of the toilet bowl rim to a vertical orientation in relation to the intermediate section and the toilet bowl rim;

a second splash guard member permanently connected to the arm sections, said second splash guard member being connected to the intermediate section by a fold joint which permits the second splash guard member to rotate from a position overlaying the intermediate section to a vertical orientation in relation to the intermediate section and the toilet bowl rim; and splash guard connection means for fixedly attaching the splash guard to the toilet seat.

9. The urine splash guard as in claim 8 wherein both arm sections and the second splash guard member are rotatable from a flat orientation on the toilet bowl rim to a vertical orientation in relation to the toilet bowl rim.

10. The urine splash guard as in claim 8 wherein the splash guard connection means is fixedly attached to the second splash guard member.

11. The urine splash guard as in claim 8 further comprising fold joints between the arm sections and the second splash guard member.

12. The urine splash guard as in claim 8 whereby when the toilet bowl seat is moved from a position over the toilet bowl rim to a vertical position, the arm sections and second splash guard member are compelled to their vertical orientations.

* * * * *